US006510904B1

(12) United States Patent
Tyrrell

(10) Patent No.: US 6,510,904 B1
(45) Date of Patent: Jan. 28, 2003

(54) PROTECTED TOOL BUSHING FOR AN IMPACT HAMMER

(75) Inventor: Daniel E. Tyrrell, Ravenna, OH (US)

(73) Assignee: Nippon Pneumatic Mfg. Co., Ltd., Osaka (JP)

( * ) Notice: Subject to any disclaimer, the term of this patent is extended or adjusted under 35 U.S.C. 154(b) by 0 days.

(21) Appl. No.: 09/578,402

(22) Filed: May 26, 2000

(51) Int. Cl.[7] ..... B25D 17/00

(52) U.S. Cl. ..... 173/132; 173/128; 173/210

(58) Field of Search ..... 173/210, 128, 173/132; 279/19.1, 19.2, 19.3, 19.4, 19.5, 19.6, 19.7

(56) References Cited

U.S. PATENT DOCUMENTS

| | | | | |
|---|---|---|---|---|
| 2,512,149 A | * | 6/1950 | GArtin | 279/19.5 |
| 2,853,973 A | * | 9/1958 | Fish | 173/132 |
| 4,664,394 A | | 5/1987 | Theissig et al. | |
| 5,137,096 A | | 8/1992 | Druesdow | |
| 5,145,265 A | * | 9/1992 | Flem | 389/296 |
| 5,388,842 A | | 2/1995 | Piras et al. | |
| 5,392,865 A | | 2/1995 | Piras | |
| 5,755,294 A | * | 5/1998 | Lee | 173/210 |
| 5,788,430 A | | 8/1998 | Meyen et al. | |
| 5,873,579 A | * | 2/1999 | Prokop et al. | 175/296 |
| 5,878,823 A | | 3/1999 | Henriksson | |
| 5,944,120 A | * | 8/1999 | Barden | 173/135 |
| 5,971,403 A | | 10/1999 | Yahagi et al. | |

* cited by examiner

*Primary Examiner*—Scott A. Smith
*Assistant Examiner*—Chukwurah Nathaniel
(74) *Attorney, Agent, or Firm*—Fay, Sharpe, Fagan, Minnich & McKee

(57) ABSTRACT

An improved bushing for a heavy duty hydraulic hammer provides increased bushing life and provides cooler operation for the hammer. A Polymeric bushing is positioned near the lower end of the tool holder of a hammer surrounding the tool. The polymeric bushing is protected by a steel ring below the polymeric bushing preventing foreign objects from impacting upon the polymeric bushing.

27 Claims, 3 Drawing Sheets

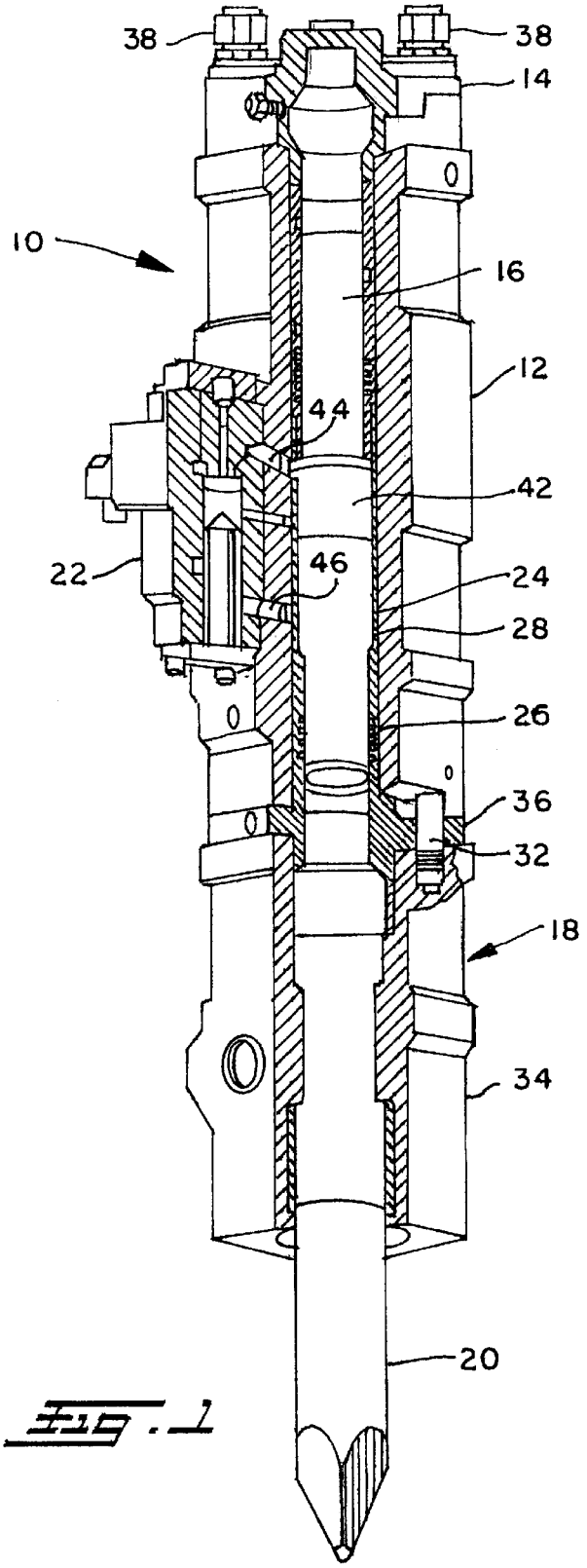
FIG. 1
FIG. 2
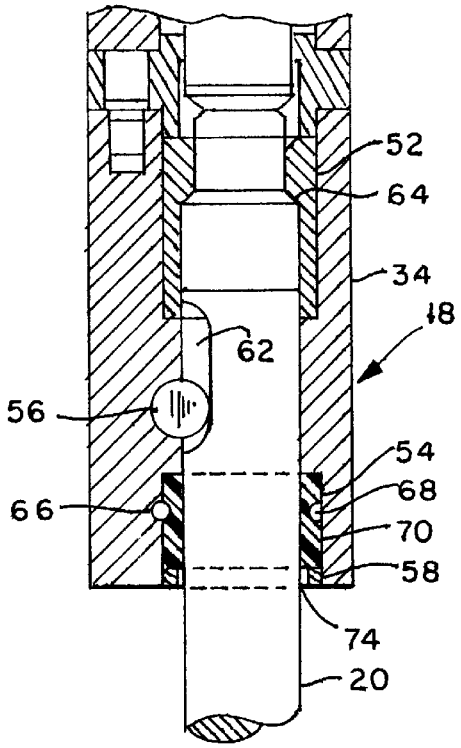
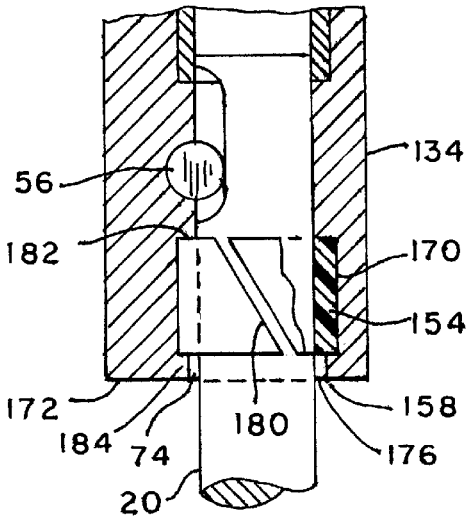
FIG. 3

PROTECTED TOOL BUSHING FOR AN IMPACT HAMMER

FILED OF THE INVENTION

This invention relates to an improved bushing engaging the tool in an impact hammer and more particularly to a low friction bushing protected from foreign objects in use.

BACKGROUND OF THE INVENTION

Hydraulic impact hammers are heavy equipment used in mining, construction, demolition, roadwork, quarrying, and similar applications. Such hammers range in size from units weighing less than 200 lbs. to units weighing more than 15,000 lbs. These hammers are used to break up concrete, rock, ore, and the like. They are also sometimes used to remove surface portions from an underlying substrate.

Hydraulic impact hammers generally comprise a housing having a central cylinder. A piston is contained within the cylinder. The top end of the cylinder communicates with or forms part of a gas chamber. The bottom end of the cylinder communicates with a bore in a tool holder which is connected to the housing. The tool holder contains a tool, such as a chisel point, which will strike a workpiece. A valve is attached to the housing and controls the flow of hydraulic fluid into the cylinder. The hydraulic fluid forces the piston up compressing the gas in the gas chamber. When the piston reaches a certain height, the hydraulic fluid is allowed to exit the portion of the cylinder below a piston seal and the piston is brought down forcefully to strike the tool. The tool is thus sharply hammered and in turn impacts upon the substrate desired to be broken or modified. The operation of the valve causing the piston to travel upward and allowing it to travel downward is automatic. The piston reciprocates rapidly resulting in numerous forceful blows of the tool against the substrate. The impact frequency, the number of impacts per minute, of a hydraulic impact hammer ranges from about 200 to over 2000 impacts per minute. Each impact involves significant amounts of energy. At high impact rates, large amounts of energy are used and/or dissipated. Because of the large amounts of force and energy involved, hydraulic impact hammers must be built robustly.

Hydraulic impact hammers create dust, debris and obstructions by their operation. Breaking-up of concrete results in dust, flying stones and particles of concrete and exposed reinforcing rod (rebar). The dust is created at the working end of the hammer as are the flying stones and other particles. The dust and flying particles can be moving quickly and can penetrate between working parts causing wear and interfering with operation. Rebar is often encountered in breaking up concrete. As it is long, often relatively slim, and tough, it can cause damage. The environments in which hydraulic impact hammers are used are often difficult environments.

One mechanism developed to compensate for the difficult environment described and the intrusion of particles into the lower end of the hammer is the use of bushings. The tool holder, holding the tool in place at the bottom of the hammer does not bear directly against the tool. Rather, a cylindrical bushing is fitted into a recess in the bottom end of the tool holder and surrounds the tool. Such bushings are sometimes made of steel and sometimes made of nylon or another polymer. The bushings do not move with respect to the tool holder. Therefore, there is no wear or very little wear around the bushing. The tool moves within the bushing. Wear occurs between the tool and the tool bushing. This wear is aggravated by the intrusion of dust and particles of concrete. Moreover, impacts from standing rebars and the like often damage the bushing. The bushing is replaceable. Thus, while the bushing and tool wear the tool holder and rest of the hydraulic impact hammer are protected.

Additionally, when one uses a steel bushing and a steel tool, frictional forces generate significant heat where the tool rubs against the tool bushing. This heat can interfere with lubrication and aggravate wear on the tool and tool bushing.

This arrangement requires that the operator check the tool and tool bushing for wear periodically. When the tool bushing is worn excessively, the hammer must be taken out of service, the tool removed and the tool bushing removed from the tool housing. After the tool bushing and tool are replaced, the hammer can be placed back in service. Significant maintenance costs and down time are thereby incurred.

Plastic, often nylon, bushings have been used in place of steel bushings. Such bushings fail frequently. One mechanism of failure is cracking of the bushings. Once the bushing starts to crack, it quickly deteriorates and must be replaced.

SUMMARY OF THE INVENTION

The present invention provides an improved bushing and tool housing structure which overcomes many of the above referred to problems, minimizes wear, extends bushing life, and is easy to maintain. In accordance with the present invention, there is provided a tool holder assembly for a hydraulic impact hammer in which the lower end of the central bore contains a polymeric or plastic bushing adapted to surround a tool and a metallic bushing protector below the bushing having an inside diameter slightly larger than the inside diameter of the bushing.

Further in accordance with the invention, a recess is provided in the lower end of the tool holder of a hydraulic impact hammer and a cylindrical polymeric bushing is contained in the recess. The polymeric bushing has an inside diameter slightly larger than the outside diameter of the tool being supported. A robust steel ring is pressed into the recess below the polymeric bushing. This steel ring has an inside diameter slightly larger than the bushing so it does not engage against a tool but protects the bushing from impact by flying debris, upstanding rebar or the like.

Still further in accordance with one aspect of the invention, the bushing protector is an add-on device for existing hammer designs in which a steel ring is pressed into the tool holder and is held in place by an interference fit.

Further in accordance with another aspect of the invention, the bushing protector is part of an original design in which the bushing protector is machined from the same workpiece as the tool holder and is integral with the tool holder.

Yet further in accordance with the invention, the polymeric bushing is generally cylindrical in shape and is retained in the tool holder by the bushing protector. Still further in accordance with the invention, a cylindrical polymeric bushing is provided with a generally axial gap which allows the bushing to be compressed to have a smaller outside diameter, inserted through the bushing protector and expanded within a recess in the tool holder where it will engage a tool.

Still further in accordance with the invention, the gap in the cylindrical tool is skewed with respect to the axis of the tool.

Still further in accordance with the invention, the diameter of the opening through the bushing protector is at least one-quarter (¼) inch larger than the diameter of the polymeric bushing central opening.

Yet further in accordance with the invention, the diameter of the bushing protector central opening is between about one-eighth (⅛) inch (2 millimeters) and one-half (½) inch (12 millimeters) larger than the diameter of the central opening of the polymeric bushing.

Still further in accordance with the invention, the bushing protector is at least one-half (½) inch (12 millimeters) long in the axial direction.

Yet further in accordance with the invention, the bushing protector is between one-half (½) inch (12 millimeters) and three (3) inches (75 millimeters) long in the axial direction.

It is the principal object of the present invention to provide a tool holder assembly for a hydraulic impact hammer in which the components last longer, are less prone to failure, produce less heat, and are reasonably maintained.

It is another object of the present invention to provide a polymeric tool bushing for an impact hammer which is protected from impact and abrasion by foreign bodies.

It is still another object of the present invention to provide a tool bushing for a hydraulic impact hammer which will be easily installed and replaced.

It is yet another object of the present invention to provide a tool holder assembly for a hydraulic impact hammer which minimizes the heat produced by movement of the tool within the tool holder.

It is still another object of the present invention to provide a tool holder assembly for a hydraulic impact hammer which increases the service life of tool bushing parts thereby increasing uptime of the hammer.

It is still another object of the present invention to provide a tool bushing assembly for a hydraulic impact hammer which is easy and inexpensive to maintain, and reduces the operating costs of the impact hammer over its life.

These and other objects of the present invention will become apparent to those skilled in the art from the following description taken in conjunction with the accompanying drawings wherein:

FIG. 1 shows a hydraulic impact hammer, partially cut away, in accordance with the first embodiment of the present invention;

FIG. 2 shows the tool holder assembly and associated element seen in FIG. 1 in cross-section and in greater detail;

FIG. 3 shows the lower portion of the tool holder seen in FIGS. 1 and 2 with a second embodiment of the invention showing alternate tool bushing and tool holder structures;

DESCRIPTION OF PREFERRED EMBODIMENTS

Figure 4:
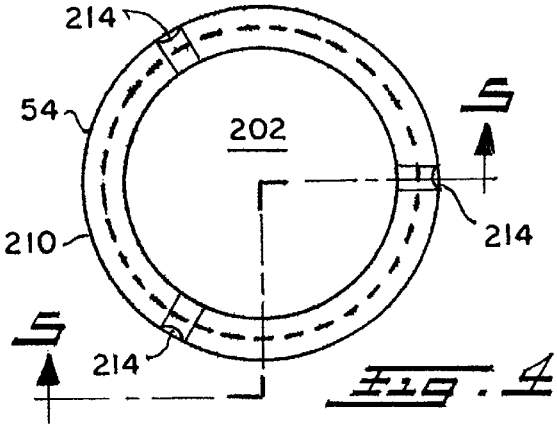
FIG. 4 shows a tool bushing as shown in FIG. 2 in a top plan view.

Referring now to the drawings wherein the showings are made for the purposes of illustrating preferred embodiments of the invention only and not for purposes of limiting the invention, FIG. 1 illustrates a heavy duty hydraulic impact hammer 10 in accordance with the invention. The hammer will normally be mounted in a bracket which supports the hammer and allows connection to an excavator. The bracket elements are conventional and not illustrated. It should be remembered in the following description that hydraulic impact hammers are large and heavy weighing up to about 15,000 lbs. and more. The hydraulic impact hammer 10 includes a main housing 12, a gas head 14, a piston 16, a tool holder assembly 18, a tool 20, and a valve 22. The impact hammer 10 also includes replaceable sleeves 24 forming a cylinder 28 and seals 26 between the piston 16 and the main housing 12. The sleeves 24 and seals 26 are replaceable and ease maintenance of the product. The valve 22 comprises several parts, the operation of which is briefly described hereinafter. All of these elements, except the novel tool holder assembly 18, to be described herein below, are described in publications available to those skilled in the art. They will not be described in great detail herein. For those who wish additional information, reference should be made to publications such as the NPK Hydraulic Hammer Service Manual published by NPK Construction Equipment, Inc. of 7550 Independence Drive, Walton Hills, Ohio 44146.

The above-described major elements are held together by tie-rods 32. The tie-rods threadably engage a tool holder 34 and pass upwardly through a spacer 36. The tie-rods 32 pass through openings in the main housing 12 and exit through the top of the gas head 14. Four tie-rod nuts 38 are threaded onto the exposed ends of the tie-rods 32 and tightened to hold the entire hydraulic impact hammer 10 together.

The piston 16 is generally cylindrical with a portion of enlarged diameter 42 near its center. Hydraulic fluid ports communicate with the interior of the cylinder 28 containing the piston 16. The upper of these ports 44 communicates with the cylinder 28 above the enlarged center of the piston 42. The lower of these ports 46 communicates with the cylinder below the enlarged center portion of the piston 42. Hydraulic fluid enters the cylinder through the lower port 46, drives the piston upwardly and compresses the gas contained in the gas head 14. After the piston reaches a certain height, the valve 22 allows hydraulic fluid to exit the portion of the cylinder 28 below the enlarged center of the piston 42, flow through the valve 22 and into the portion of the cylinder 28 above the enlarged center of the piston. The piston moves down forcefully driven by the compressed gas in the gas head 14 and strikes the tool 20. The valve returns to its configuration directing high pressure hydraulic fluid through the lower port 46 and again drives the piston upwardly in the cylinder 28. This series of events occurs rapidly. The frequency of impacts upon the tool in a typical hydraulic impact hammer is several hundred beats per minute. The above-described operation is conventional.

As described above, the piston 16 moves up and down forcefully several hundred times per minute. When it moves down, it strikes the tool 20 causing the tool to strike a workpiece and/or move down forcefully within the tool holder assembly 18. The tool 20 is subject to a variety of forces in use. The tool 20 will normally be applied to and in contact with a workpiece. However, the axis of the tool 20 will not always be directly perpendicular to the workpiece. Thus, reactions from impacts against a workpiece will often include large radial components as well as axial components. Even when the tool 20 is directly perpendicular to a workpiece, reaction forces will vary as the workpiece is broken up. Thus, the tool 20 will reciprocate axially within the tool holder assembly subject to both large axial forces and impacts and large radially directed forces.

Conventionally, bushings are provided in the tool holder assembly 18. The tool 20 slides axially making contact with these bushings rather than the tool holder 34 itself. Steel bushings are used in many hammers as steel is a robust material. However, the sliding friction of the tool upon the bushings creates significant heat and wear. Grease fittings are provided in conventional tool holder assemblies 18. The application of grease lessens the friction. However, heat and the difficult environment in which hammers operate interfered with the ability of grease to minimize wear and friction.

When a bushing becomes worn out of specification, it is removed from the tool holder and a new bushing pressed into place. The lower bushing, being closest to the point of impact of the tool 20, suffered the most severe wear.

As best seen in FIG. 2, in accordance with the present invention, a tool holder assembly 18 is provided comprising a tool holder 34, an upper bushing 52, a lower bushing 54, a tool retaining pin 56, and a bushing protector 58. The tool holder 34 generally surrounds the tool 20. The tool retaining pin 56 engages in a recess 62 in the tool 20. The tool retaining pin 56 prevents the tool 20 from falling out of the tool holder assembly 18 as it engages the top of the recess 62 when the tool is in the fully down position. The tool 20 is restrained from moving too far upwardly within the tool holder 18 by a shoulder 64 in the upper bushing 52.

An enlarged generally cylindrical recess 70 is provided at the lower end of the tool holder 34. The lower bushing 54 resides in this enlarged cylindrical recess 70 and surrounds the tool 20. The lower bushing 54 is retained in place by a bushing pin 66 passing through an aperture in the tool holder 34 and a recess 68 in the lower bushing. As seen in FIG. 2, the lower bushing 54 is a polymeric material. Nylon or other tough plastic materials are preferred. The outside diameter of the lower bushing 54 is about equal to the inside diameter of the enlarged cylindrical recess 70. If the lower bushing is unslotted, it is pressed into place. The lower bushing 54 has an inside diameter slightly larger than the outside diameter of the tool 20 allowing the tool to reciprocate within the bushing 54 while being supported by the bushing 54. The bushing protector 58 is a ring of steel having an outside diameter substantially equal to the inside diameter of the recess 70. The bushing protector 58 is pressed into the recess 70 in an interference fit. The inner diameter of the bushing retainer is slightly larger than the inside diameter of the lower bushing 54. Therefore, the tool 20 does not bear against the bushing retainer 58 but rather rides on the lower bushing 54. A steel on nylon bearing surface is provided at the lower extremity of the tool holder assembly 18 rather than a steel on steel engagement as in some conventional impact hammers.

The embodiment shown in FIG. 2 uses a tool holder 34 similar in shape to the tool holder used in some prior art hammers. Such prior art tool holders used lower bushings extended all the way to the bottom of the recess 70. No bushing protector 58 was provided. The present invention can be used in such prior art hammers by removing the existing lower bushing and inserting a new nylon bushing 54 and steel bushing protector 58 in the existing tool holder 34. A protected nylon bushing is thereby provided.

The relative dimensions of the tool 20, the lower bushing 54 and the bushing protector 58 are important. In a hammer using an eight-inch diameter tool, the inside diameter of the lower bushing 54 is 204.2 millimeters (8.04 inches). The inside diameter of the steel bushing protector 58 is 210 millimeters (8.27 inches). An annular space 74 is present between the outside diameter of the tool 20 and the inside diameter of the bushing protector 58. This annular space 74 has a thickness of about three millimeters (⅛ inch) around the entire circumference of the tool 20. Thus, the tool bears against the polymeric lower bushing 54 but does not bear against the steel bushing protector 58. Moreover, the polymeric lower bushing 54 is protected from damage by upstanding rebar or other materials which could crack and destroy it. Such materials are prevented from entering into contact with the bushing or the steel bushing protector 58. Rebar and other similar materials are unlikely to penetrate through a three (3) millimeter (⅛ inch) gap.

The axial length of the bushing protector can vary according to the size of the hammer. However, the bushing must have the strength to withstand impact from obstructions. On the other hand, the bushing 54 must be near the bottom of the tool holder. A two (2) inch (50 millimeters) axial length is appropriate for an eight-inch hammer. The axial length may vary from one-half (½) inch (12 millimeters) to three (3) inches (76 millimeters) or more.

Applicants have found that this arrangement results in a significant reduction in the heat generated at the lower bushing when the hammer is in operation. Moreover, this arrangement provides a substantially lengthened lifetime for a polymeric bushing and a hammer. Steel bushings get hot and wear. Unprotected nylon bushings are prone to failure by cracking and disintegration caused by impact with rebar or other hazards during operation of the hammer.

The above referred to dimensions are applicable over a broad range of hammer sizes. Hammers using smaller tools, for instance, a five-inch diameter tool, are supported in a lower bushing having a snug fit around the tool. The bushing protector 58 has an inside diameter selected to provide an annular space 74 having a thickness of approximately three millimeters (⅛ inch). The same relationship holds for hammers using larger diameter tools. Applicant provides a polymeric lower bushing 54 which fits snugly around the tool thereby providing a bearing surface and a bushing protector 58 having an inside diameter providing a small gap, preferably of about three millimeters (⅛ inch), between the steel bushing protector 58 and the tool 20.

FIG. 3 illustrates another embodiment of the invention. FIG. 3 shows the lower extremity of a hammer as seen in FIG. 1. The tool holder 134 is provided with recess 170 which is spaced upwardly from the lower end 172 of the tool holder 134. The recess 170 has an inside diameter which is enlarged with respect to the inside diameter of the rest of the tool holder 134. It receives a lower bushing 154 which has an internal diameter which snugly supports the tool 20. The lower end 172 of the tool holder 134 has a circular opening 176 with an inside diameter about six millimeters (¼ inch) larger than the outside diameter of the tool 20. This provides an annular space 74 identical to the annular space created by the bushing protector 58 in FIG. 2. However, the lower end 172 of the tool holder 134 is integral to the tool holder 134 and provides the same functionality as the bushing retainer 58 seen in FIG. 2. In effect, the tool holder 134 has an integral bushing protector 158.

The lower bushing 154 is provided with a slot 180 extending from its upper end 182 to its lower end 184. Should the bushing 154 require replacement, an operator will remove the tool retaining pin 56 and the tool 20. If a bushing pin 66 is present, it will also be removed. The operator can then use tools to radially compress the lower bushing 154 and remove it through the circular opening 176. A new bushing 154 can then be radially compressed by hand, inserted through the circular opening 176 and allowed to expand into the recess 170. The lower bushing 154 is held in place by the integral bushing protector 158. The slot 180 is skewed with respect to the axis of the tool 20. This assures that the tool 20 is adequately supported in all radial directions.

Figure 5:
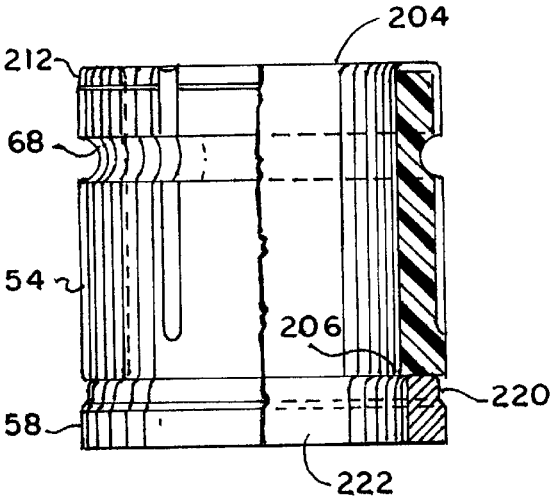
FIG. 5 shows the tool bushing of FIG. 4 in a side view cross-section taken along the line 5—5 of FIG. 4 and an associated bushing protector.

FIG. 4 shows the bushing 54 seen in FIG. 2 in greater detail. FIG. 5 shows the bushing of FIG. 4 in side elevation partially cut away with the bushing protector 58 below it. The lower bushing 54 is cylindrical with a central bore 202 having a general uniform cross-section over its entire length. The top end 204 and bottom end 206 of the central bore are provided with rounded edges. The external surface 210 of the bushing 54 is generally cylindrical. The topmost portion 212 of the external surface 210 has a slightly reduced diameter which eases insertion of the bushing into the tool holder 34. Three grooves 214 are spaced evenly around the periphery of the external surface 210 of the bushing 54. The grooves 214 do not extend all the way to the bottom of the tool bushing 54. They do extend all the way to the top of the tool bushing and also continue across the top surface of the tool bushing to the central bore 202. A circumferential recess 68 is present around the entire periphery of the external surface 210 near the top end 204. As seen in FIG. 2, the recess allows passage of a pin 66 which holds the lower tool bushing 54 in place. The circumferential recess 68 and pin 66 are not necessary in the present invention as a retaining function is accomplished by the bushing protector 58. However, as existing units using steel bushings include bushing pins 66, the recess allows easy retro fit of the present invention.

As best seen in FIG. 5, the steel bushing protector 58 is a ring-shaped structure having a bore with a general uniform diameter over its length. The outside surface of the bushing protector 58 is generally cylindrical. The top portion 220 of the bushing protector 58 has a reduced diameter to ease pressing the bushing protector 58 into the bottom of the tool holder 34. The portion of the bushing protector 58 below the top portion 220 has a larger diameter and must be pressed into the tool holder 34 where it will be retained in interference fit. As can best be seen in FIG. 5, the diameter of the bore 222 of the bushing protector 58 is about six millimeters (¼ inch) larger than the diameter of the central bore 202 of the lower bushing 54. This provides for the three millimeters (⅛ inch) annular space 74 described above.

Figure 6:
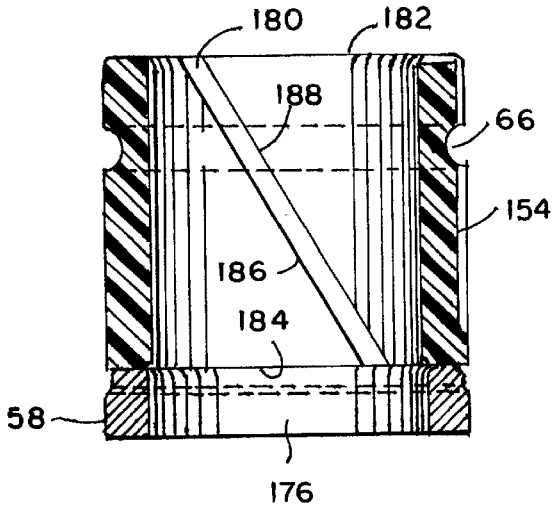
FIG. 6 shows a bushing and bushing protectors in cross-section similar to that seen in FIG. 5 with the addition of a slot in the bushing.

FIG. 6 shows a bushing 154 and bushing retainer 58 identical in all respects to that seen in FIG. 5 save one. The bushing 154 of FIG. 6 is provided with a slot 180 extending from the bushing upper end 182 to the bushing lower end 184. The slot 180 is skewed with respect to the axis of the tool 20 (not shown). The slot 180 is sufficiently wide to allow one to insert a screwdriver or other similar tool through the slot to pry up a portion of the bushing 154 so that it may be grasped and pulled inwardly. The two edges of the gap 186, 188 can be overlapped and the outside diameter of the lower bushing 154 can be made smaller than the circular opening 176 allowing one to remove a worn bushing and replace it with a fresh bushing. This can be done without removing the bushing protector 58.

Figure 7:
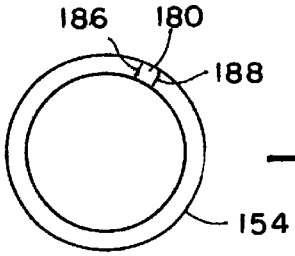
FIG. 7 shows a top view of the tool bushing as seen in FIG. 6 showing a slot with radial side walls.
Figure 8:
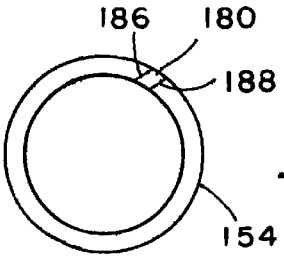
FIG. 8 shows a top view of a bushing as seen in FIG. 6 with a slot having skewed side walls.

FIG. 7 shows a simplified top view of the bushing 154 seen in FIG. 6. In the embodiment seen in FIG. 7, the slot edges 186, 188 are generally perpendicular to the slot inner and outer surfaces. Alternatively, the slot edges 186, 188 can be skewed or slanted with respect to the inner and outer surfaces as seen in FIG. 8. The skewed or slanted edges 186, 188 make it easier for an operator to compress the bushing for removal. The width of the slot 180 is not critical. It should be wide enough when installed to allow one to remove a worn or cracked bushing. It should be narrow enough so that the proper support is provided for the tool in operation.

Figure 10:
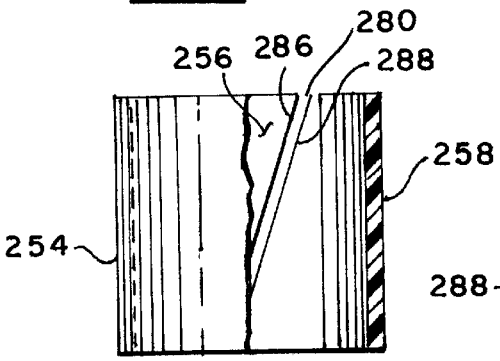
FIG. 10 shows another embodiment of a bushing usable in the invention seen in FIGS. 1 and 2.
Figure 9:
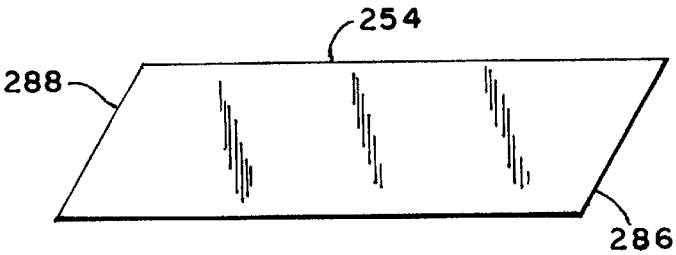
FIG. 9 shows an alternate construction of a bushing usable in the invention in plan view.

FIGS. 9 and 10 shows another embodiment of a bushing usable with the invention. With reference to FIG. 10, the bushing 254 is a slotted cylinder having a central bore 256 of uniform diameter over its entire length and a cylindrical outer surface 258 having a uniform diameter over its entire length. The bushing 254 is provided with a slot 280 which can be configured as seen in FIG. 7 or in FIG. 8. The bushing of FIG. 10 is substantially less thick than the bushings seen in FIGS. 5 and 6. To compensate for this lessened thickness, the annular space 170 (FIG. 3) in which the bushing 254 is retained has a smaller diameter. The bushing can be molded into a cylindrical shape as seen in FIG. 10. It is easily installed as it is relatively flexible because of its diminished thickness. The two edges of the gap 286, 288 are easily drawn into an overlapping relationship for installation or removal.

Alternatively, the bushing 254 seen in FIG. 10 can be fabricated as a sheet of polymeric material in the form of a trapezoid as shown in FIG. 9. The two short edges 286, 288 of the trapezoid form the edges of the gap 280 when the sheet is rolled into a cylindrical form. The sheet is held in the appropriate cylindrical form when installed in the cylindrical recess 170.

Figure 11:
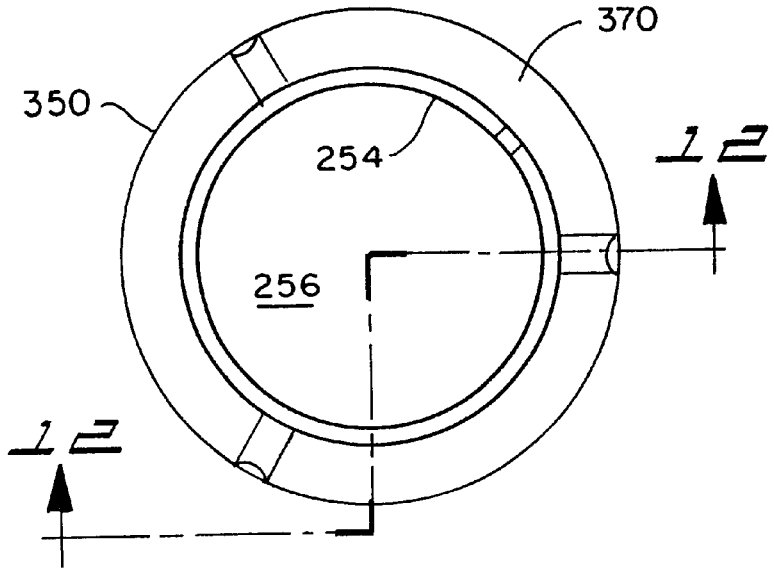
FIG. 11 is a top view of an alternate lower bushing holder and lower bushing usable in the invention; and, FIG. 12 shows the bushing holder and bushing of FIG. 11 in a side view cross-section taken along line 12—12 of FIG. 11.
Figure 12:
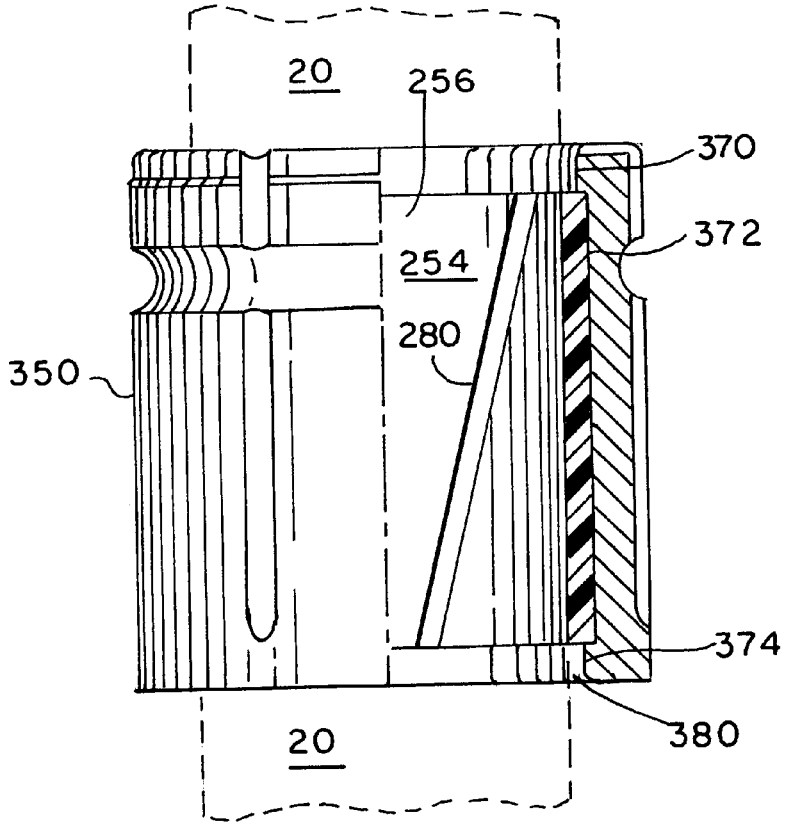

FIGS. 11 and 12 show another bushing usable with the invention. A metallic lower bushing holder 350 has external dimensions identical in all respects to a conventional metallic bushing. Thus, the metallic lower bushing holder 350 can be used as a direct field replacement for conventional hydraulic impact hammers using metallic bushings. The metallic lower bushing holder 350 fits into the enlarged cylindrical recess 70 (FIG. 2). The interior surface of the metallic lower bushing holder 350 consists of an upper cylindrical land 370, a central cylindrical recess 372 and a lower cylindrical land 374. The central recess 372 has an inside diameter slightly larger than the upper land 370 and lower land 374. The central recess 372 accepts a polymeric bushing 254 identical in all respects to the polymeric bushing 254 shown in FIG. 10 or the variant shown in FIG. 9.

The interior surface of the polymeric bushing 254 defines a central bore 256 which supports a tool 20 (FIG. 2 and dashed lines FIG. 12) in a bearing relationship. The upper land 370 and lower land 372 have diameters slightly larger than the central bore 256 diameter and do not engage the tool 20. The lower land 374 has an internal diameter slightly larger e.g. ¼ inch (6 mm) than the diameter of the tool 20. Only a small annular space 380 exists between the tool 20 and the lower land 374. This annular space 380 is only about ⅛ (3 mm) wide. The lower land prevents rebar and other foreign matter from striking and damaging the polymeric bushing 254. The lower land 374 need only be about ½ inch (12 mm) in axial length to perform its function, but can be longer.

The polymeric bushing 254 has a slot 280 which eases removal of a worn bushing 254 and installation of a new bushing 254. The tool 20 is removed. A hand tool such as a screw driver is used to pry up the bushing 254 at the slot 280 and the bushing is grasped and removed. A new bushing 254 is compressed radially and placed in the recess 372. The new bushing is allowed to expand into the recess 372 where it is retained by the lands 370 and 374. The tool 20 is reinstalled and the hammer returned to service.

The invention has been described with reference to preferred embodiments. Obviously, modifications and alterations will occur to others upon a reading and understanding of this specification. For instance, a portion or all of the upper tool bushing may be nylon. It is intended to include such modifications and alterations insofar as they come within the scope of the appended claims or the equivalents thereof.

Having thus described the invention, it is claimed:

1. A tool holder assembly for a hydraulic impact hammer having a tool, said tool holder assembly comprising:

a tool holder having a central bore accommodating said tool, said bore having an upper end and a lower end;

a polymeric bushing surrounding said tool, said polymeric bushing being positioned within said tool holder near the lower end of said bore, said polymeric bushing having internal dimensions adapted to engage said tool; and, a metallic bushing protector having an aperture with dimensions slightly larger than said bushing internal dimensions positioned at said tool holder lower end said bushing protector being spaced from said tool.

2. The assembly of claim 1 wherein said bushing protector is a portion of said tool holder.

3. The assembly of claim 1 wherein said tool has a circular cross-section having a constant diameter over a portion of its length and said polymeric bushing has a generally circular central opening having a diameter slightly larger than said tool diameter and said bushing protector has a generally circular central opening having a diameter larger than said polymeric bushing central opening diameter; and, said tool bears against said bushing and is supported by said bushing.

4. The assembly of claim 3 wherein said bushing protector central opening diameter is about one-qua (¼) inch (six millimeters) larger than said polymeric bushing central opening diameter.

5. The assembly of claim 3 wherein said bushing protector central opening diameter is between about one-eighth (⅛) inch (2 millimeters) and one-half (½) inch (12 millimeters) larger tan said polymeric bushing central opening diameter.

6. The assembly of claim 3 wherein said bushing is nylon.

7. The assembly of claim 3 wherein said polymeric bushing has a generally uniform thickness, a generally constant internal diameter over its length, a generally constant external diameter over its length and is carried in a cylindrical recess in said tool holder.

8. The assembly of claim 7 wherein said bushing protector retains said polymeric bushing in said recess.

9. The assembly of claim 7 wherein said polymeric bushing has a generally longitudinal relatively narrow gap.

10. The assembly of claim 9 wherein said gap is skewed from longitudinal.

11. The assembly of claim 9 wherein said gap is sufficiently large so that said polymeric bushing may be compressed to have an outside diameter smaller than said bushing protector central opening diameter whereby said polymeric bushing may be installed through said bushing protector central opening.

12. The assembly of claim 1 wherein said bushing is nylon.

13. The assembly of claim 1 wherein said bushing protector is at least about one-half (½) inch (12 millimeters) long in an axial direction.

14. The assembly of claim 13 wherein said bushing protector is at least one inch (25 millimeters) long in an axial direction.

15. The assembly of claim 14 wherein said bushing protector is about two inches (50 millimeters) long in an axial direction.

16. The assembly of claim 1 wherein said bushing protector is between about one-half (½) inch (12 millimeters) and three (3) inches (76 millimeters) long.

17. A hydraulic impact hammer comprising:

a housing having a cylinder having a top and a bottom;

a gas chamber communicative, with said cylinder;

a piston within said cylinder adapted to reciprocate longitudinally;

a valve adapted to control the flow of hydraulic fluid to said cylinder, such that said piston is driven to reciprocate longitudinally;

a tool holder fixed to said housing bottom, said tool holder having a central bore, said bore having an upper end and a lower end;

a tool within said bore;

a polymeric bushing surrounding said tool, said polymeric bushing being positioned within said tool holder near the lower end of said bore, said polymeric bushing having internal dimensions adapted to engage said tool; and, a metallic bushing protector having an aperture with dimensions slightly larger than said bushing internal dimensions positioned at said tool holder lower end said busing protector being spaced from said tool.

18. The hammer of claim 17, wherein said bushing protector is a portion of said tool holder.

19. The hammer of claim 18, wherein said tool has a circular cross-section having a constant diameter over a portion of its length and said polymeric bushing has a generally circular central opening having a diameter slightly larger than said tool diameter and said bushing protector has a generally circular central opening having a diameter larger than said polymeric bushing central opening diameter; and, said tool bears against said bushing and is supported by said bushing.

20. The hammer of claim 19 wherein said bushing protector central opening diameter is about one-quarter (¼) inch (six millimeters) larger than said polymeric bushing central opening diameter.

21. The hammer of claim 19 wherein said bushing protector central opening diameter is between about one-eighth (⅛) inch (2 millimeters) and one-half ( ) inch (12 millimeters) larger than said polymeric bushing central opening diameter.

22. The hammer of claim 21 wherein said bushing protector is at least about one-half (½) inch (12 millimeters) long in an axial direction.

23. The hammer of claim 19 wherein said polymeric bushing has a generally uniform thickness, a generally constant internal diameter over its length, a generally constant external diameter over its length and is carried in a cylindrical recess in said tool holder.

24. The hammer of claim 23 wherein said bushing protector retains said polymeric bushing in said recess.

25. The hammer of claim 23 wherein said polymeric bushing has a generally longitudinal relatively narrow gap.

26. The hammer of claim 25 wherein said gap is skewed from longitudinal.

27. The hammer of claim 25 wherein said gap is sufficiently large so that said polymeric bushing may be compressed to have an outside diameter smaller than said bushing protector central opening diameter whereby said polymeric bushing may be installed through said bushing protector central opening.

* * * * *